US005915905A

United States Patent [19]

Hopland

[11] Patent Number: 5,915,905

[45] Date of Patent: Jun. 29, 1999

[54] SYSTEM FOR LOADING AND UNLOADING CARGO UNIT SUCH AS PALLETIZED CARGO IN CARGO VESSELS

[75] Inventor: Moritz Hopland, Austerheim, Norway

[73] Assignee: TTS-Mongstad AS, Isdalso, Norway

[21] Appl. No.: 08/967,581

[22] Filed: Nov. 10, 1997

Related U.S. Application Data

[63] Continuation of application No. 08/702,579, Sep. 3, 1996, abandoned.

[30] Foreign Application Priority Data

Mar. 11, 1994 [NO] Norway ..... PCT/NO94/00056

[51] Int. Cl.[6] ..... B63B 27/16

[52] U.S. Cl. ..... 414/139.4; 414/137.4

[58] Field of Search ..... 414/137.4, 141.3, 414/141.7, 141.6, 142.6, 142.7, 142.8

[56] References Cited

U.S. PATENT DOCUMENTS

| | | | |
|---|---|---|---|
| 4,878,796 | 11/1989 | Ammeraal | 414/141.7 |
| 4,897,012 | 1/1990 | Brewer | 414/137.4 X |
| 5,271,701 | 12/1993 | Hopland | 414/141.7 X |

FOREIGN PATENT DOCUMENTS

| | | | |
|---|---|---|---|
| 55-89135 | 7/1980 | Japan | 414/141.7 |
| 134864 | 9/1976 | Norway . | |
| 167505 | 8/1991 | Norway . | |
| WO 90/08690 | 8/1990 | WIPO | 414/142.8 |

*Primary Examiner*—Janice L. Krizek
*Attorney, Agent, or Firm*—McAulay Nissen Goldberg Kiel & Hand, LLP

[57] ABSTRACT

A system for loading and unloading cargo units in refrigeration cargo ships, comprising a first elevator, which is moveable in a vertical elevator shaft internally in the ship, and a second elevator, which is moveable along the outer side of the side of the ship, together with horizontal conveyors between the elevators. An elevator shaft for the first elevator is arranged a substantial distance within the upper portion of the side of the ship, towards the midships line, to form a buffer zone or intermediate storage zone for cargo units in a region between the elevators.

19 Claims, 4 Drawing Sheets

SYSTEM FOR LOADING AND UNLOADING CARGO UNIT SUCH AS PALLETIZED CARGO IN CARGO VESSELS

This is a continuation of application, now abandoned Ser. No. 08/702 579, filed on Sep. 3, 1996.

The present invention relates to a system for loading and unloading cargo units in cargo vessels, more especially refrigerated cargo ships for transporting fruit, meat or fish which are placed on freight pallets, comprising a first elevator, which is moveable in a substantially vertical elevator shaft internally in the vessel, and a second elevator, which is moveable on the outer side of the side of the vessel, together with horizontal conveyors between the elevators.

In certain ships, especially in cooling ships for the transportation of fruit, the ship is—especially with respect to the cargo—intended to maintain great speed and is therefore designed with a relatively slim ship's hull with a curved contour in the length direction as well as in the height direction. Correspondingly, the side of the ship has such a curved contour that it is difficult to accommodate an elevator shaft along the side of the ship in the desired manner. Earlier a series of proposals have been presented for designing the elevator shaft with a partially curved and partially rectilinear contour along the side of the ship. However, such a specific design of the elevator shaft demands a complicated elevator arrangement and furthermore, such a design will complicate the loading and unloading operations.

With the present invention the aim is a solution where the problems with obliquely extending elevator shafts are avoided. To this end, the elevator shaft is arranged a significant distance within the side of the ship, preferably at or towards the midships line, and so that it can then pass vertically downwards just to the bottom of the hold, where the ship can otherwise have a relatively small breadth dimension and minimal operating spaces for a fork lift truck with cargo.

In NO 167 505 and corresponding U.S. Pat. No. 5,127,701 a reloading platform is shown which is arranged in a side port opening and which has a transfer means between quay and ship plus an internal elevator, which are arranged relatively closely up to the outer side of the ship. The internal elevator shaft is arranged just outside at the side of the ship and the space for the reloading platform is therefore rather limited. According to NO 167 505 there is only discussion about a reloading means between an internal elevator and an external transfer means. The known reloading platform is liftable and lowerable in the port opening and this is necessary with respect to the transfer means which is used on the quay side.

According to the present invention, on the other hand, an external elevator is employed instead of a port opening and an associated transfer means. The approach to the problem is therefore considerably different according to the invention relative to the known construction.

According to NO 134 864 there is no discussion about an external elevator and an internal elevator, but on the other hand about a first and a second elevator that move alternately on the inner side and outer side of the ship. The approach to the problem according to the invention is therefore different also relative to the last-mentioned publication, the cargo according to the last-mentioned publication being present the whole time in one and the same elevator.

With the present invention the aim is a system, where large loading and unloading capacity can be achieved by means of a relatively simple arrangement on board ship.

The system according to the invention is characterised in that a buffer zone or intermediate storage zone for cargo units is arranged on the deck of the ship in a horizontal region between a substantially vertical elevator shaft, which is arranged at a substantial distance inside the upper portion of the side of a ship, that is to say in or near the midships line, and a second elevator, which is moveable at the outer side of the side of the ship.

By means of the buffer zone or the intermediate storage zone which is arranged a substantial distance inside the side of the ship, there can be achieved according to the invention significant building advantages internally in the ship.

By arranging the elevator shaft for the internal elevator at an established distance relative to the external elevator, a relatively large buffer zone or intermediate storage zone can be achieved for cargo units horizontally between the elevators.

It is especially advantageous, from a building point of view in the ship that the buffer zone or the intermediate storage zone is arranged on the ship's deck in a housing adapted for this purpose with associated side port opening.

By this there is the possibility of avoiding otherwise conventional low lying side port openings in the ship's side and correspondingly avoiding cuttings in the ship's side plus avoiding accompanying extra reinforcements of the ship and also remaining fore-and-aft restrictions.

As the buffer zone is arranged on the upper deck of the ship, that is to say on the top of the holds, the advantage is achieved that substantial space in the ship's hold is not required, on the other hand, the capacity of the holds can be utilised to the optimum.

An arrangement with a relatively large buffer zone between the elevators makes it possible to employ a relatively small elevator on the outer side of the ship for transporting for example a pair of cargo units one at a time from quay to ship, or vice-versa, and to employ a relatively large elevator internally in the ship. The transport capacity by the two elevators can hereby be readily adapted as required in spite of the fact that these can operate with different work rhythms and operate over different lifting heights.

By means of the housing with an associated side port opening there is in addition the possibility of allowing the transport of the cargo to be effected in a protected manner internally in the ship from the side port opening, via the housing on the ship's deck, to the hold, and vice-versa, with a relatively effective utilisation of the space in the hold. Specifically it will be possible to fill the refrigeration rooms, that is to say the practically utilisable part of the holds, optimally with goods which are to be refrigerated. It is also possible to shield the hold favourably as to temperature relative to the side port opening by arranging the elevator shaft internally in the ship with a lead-in opening level with the upper deck of the ship. Favourable load lines can also be set up internally in the vessel directly to respective decks or respective floors in the hold, while the cargo can be intermediately stored internally in the ship on the upper deck of the vessel, that is to say at a level above the holds.

The invention is further characterised in that the housing can receive and protect the external elevator in an inactive position in the housing, and that the housing includes rails and an associated carriage for moving the external elevator with an associated elevator guide from the inactive position within the housing to an active position outside the housing.

The system according to the invention presents the possibility of the first, internal elevator being able to transport for example twice the number of cargo units that the second, external elevator is adapted to transport.

A particularly favourable solution consists in the housing with the associated elevator shaft being designed for the reception of two mutually independent load and unload lines, one to each of two neighbouring holds.

A common elevator shaft can hereby be employed for two load and unload lines mutually independent at the start, but with the possibility for sideways communication from line to line at different decks or different floors in the elevator shaft, for example for the transfer of the fork lift trucks from line to line or for the transfer of cargo units from line to line. Such a solution can provide an effective utilisation of the loading and unloading capacity internally in the vessel including effectively terminating the filling of optimally filled holds or effectively starting up emptying of optimally filled holds.

A favourable solution is obtained according to the invention in that the elevator guide for the external elevator can be adjusted along and just by the side of the vessel with a lower stationary unloading and loading ramp adjustable into regulatable height positions relative to the side port opening.

There is hereby the possibility of being able to regulate the lower position of the elevator in a simple and easy manner relative to the level of the quay in order to compensate for the movement of the vessel at the quay and at the same time to form a buffer zone in the form of an unloading and loading ramp at a suitable level above the top of the quay with corresponding releasing of the cargo relative to the quay. It will also be possible, particularly in such cases where the hull is curved a large distance from the quay, that said unloading and loading ramp can compensate for such a large distance and nevertheless can project sufficiently over the quay to be able to be served by fork lift trucks.

By means of the relatively large space, which is available as a buffer zone or intermediate storage zone for the cargo in the elevator shaft/housing arrangement, when the second, external elevator assumes the active position outside the side of the ship, a correspondingly large space is available for the storage of the second elevator with associated equipment in the inactive position of the elevator in the elevator shaft/housing arrangement.

By using horizontal conveyors in the buffer zone or intermediate storage zone in or connected to the elevators loading and unloading of these can be effected automatically with suitable equipment immediately the elevator has assumed its respective loading and unloading position.

A control system can hereby be obtained for the simple operation of a loading and unloading cycle by an effective cooperation between the elevators and adjacent horizontal conveyors. Further features of the invention will be evident from the following description having regard to the accompanying drawings, which show a preferred embodiment, and in which.

Figure 1:
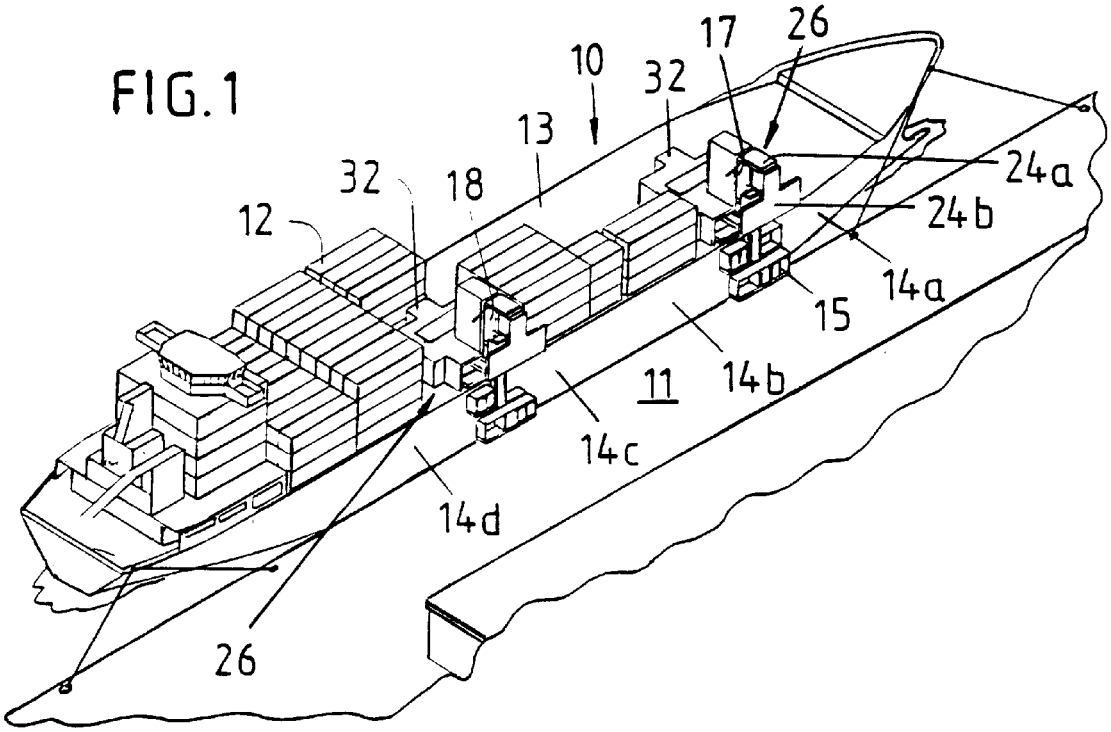
FIG. 1 shows in perspective a ship at the quay, in readiness for loading or unloading by means of two pairs of mutually independent load and unload lines, which separately constitute the system according to the invention.

In FIG. 1 there is shown a cargo vessel 10, which is illustrated moored at a quay 11 and is in readiness for loading and unloading with the system according to the invention.

The vessel is shown provided with container cargo 12, which is stacked in place on stationary upper deck 13 by means of conventional crane equipment not shown further, while the vessel has cargo holds 14*a*–14*d* which are adapted to receive cargo units 15 in the form of pallet cargo, which is handled on the quay 11 and in holds 14*a*–14*d* by means of fork lift truck 16 in the usual known manner and which is handled between quay and hold with a first elevator 19 internally in the vessel 10 and with a second elevator 21 externally along the side 10*a* of the ship.

In the illustrated embodiment a so-called refrigerated cargo vessel 10 is shown, which is specifically designed for the freighting of fruit, meat or fish. The ship 10 is designed to have great speed and has in this connection a longitudinally curved and height-wise curved ship's side 10*a*. There is employed according to the invention a vertical elevator shaft 20 which is arranged a considerable distance from the side 10*a* of the ship, that is to say just by or towards the midships line of the vessel. A vertical elevator shaft is hereby obtained completely down to the bottom of the holds both at the forward and rear end of the ship, without the use of obliquely extending elevator guides or other complicating equipment.

In the present embodiment a vessel is shown having four separate holds 14*a*–14*d*, as is indicated in FIG. 1 by two forward holds 14*a*,14*b* and two rear holds 14*c*,14*d* respectively. Each hold 14*a*–14*d* (portions of this defined respectively by way of floors or height-wise in another way) can be surrounded in the usual way by temperature insulating material. In addition each hold is provided, for example at the one end wall or at a partition wall between two neighbouring holds, with a conventional air-circulation system or air-blowing system (not shown further) for maintaining a specific temperature in the hold during the handling of cargo to and from and also within the hold respectively under the motion of the ship.

The units 15 of cargo are brought inwardly into and outwardly from the ship via two side port openings 17 and 18, that is to say via a forward opening 17 and a rear opening 18 respectively. More specifically, cargo is brought, which is unloaded from the holds 14*a* and 14*b*, in its respective separate load line upwardly from the hold, via the elevator shaft 20 (see FIG. 5) in a common elevator shaft/housing arrangement 26 and at a level above the upper deck 13 outwardly through a side port 17 or 18 in the associated elevator shaft/housing arrangement 26 and further downwards on the outside of the side 10*a* of the ship to a specific level above the quay 11.

A part 32 of the arrangement 26, which is arranged on the upper deck 13 of the vessel, defines an internal weather-protecting connecting chamber between the elevator shaft 20 and the port openings 17,18. The connecting chamber defines in addition a buffer zone 25 or an intermediate storage zone for cargo units 15 between the elevators 19 and 21.

Figure 5:
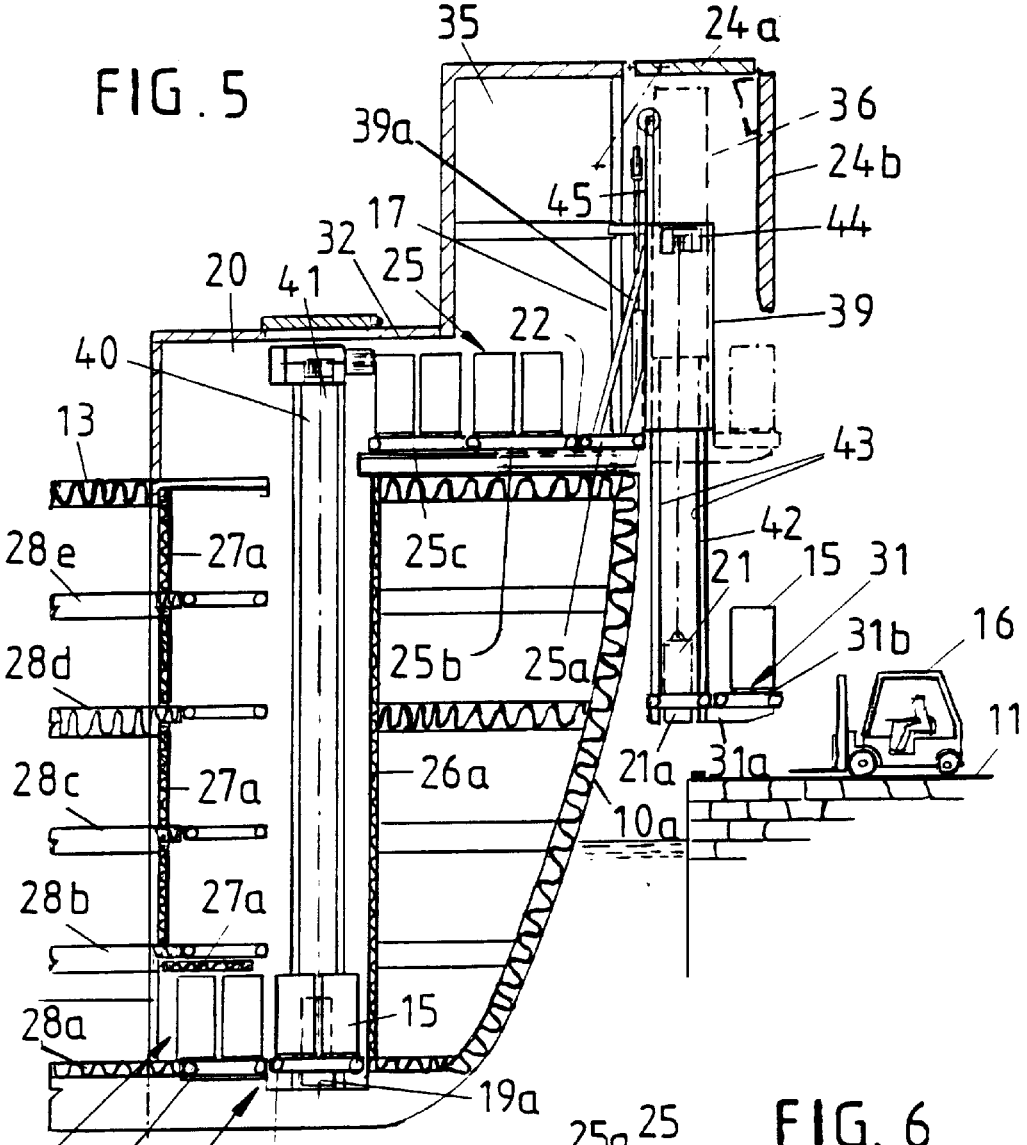
FIG. 5 shows a cross-section of the ship and associated load and unload line in a system as shown correspondingly in FIG. 1.

In FIG. 5 there is shown a buffer zone 25 with three separate conveyors 25*a*,25*b*,25*c* for intermediate storage of a large number of cargo units 15. In the intermediate space between two load and unload lines in the housing arrangement 26 (see FIG. 6) a pair of stationary rails 38 are illustrated for the support of the carriage 22 on transferring the elevator 21 from an active position outside side 10*a* of the ship to an inactive position within the housing arrangement 26.

The carriage 22 is equipped with an upper elevator carrier member 39 which is supported in the carriage 22 via oblique stay 39*a*. The elevator carrier member 39 controls the support column 42 which is provided with a pair of mutually opposite guides 43 for two equivalent elevators 21. In the illustrated embodiment (see particularly FIGS. 1 and 2) the loading platform 31*a* is provided with a housing-forming cover 31' in order to protect the cargo against weather and wind during movement of the elevator 21 between quay and ship. Correspondingly, loading platform 21*a* of the elevator 21 is surrounded by a housing-forming cover 21'.

The elevator 21 is adjusted to stop in a lower position flush with the loading platform 31, independently of which operating height to which the loading platform is adjusted relative to the quay 11. The elevator 21 is adapted to stop correspondingly in an upper position flush with the conveyors 25*a*–25*c*.

Figure 3:
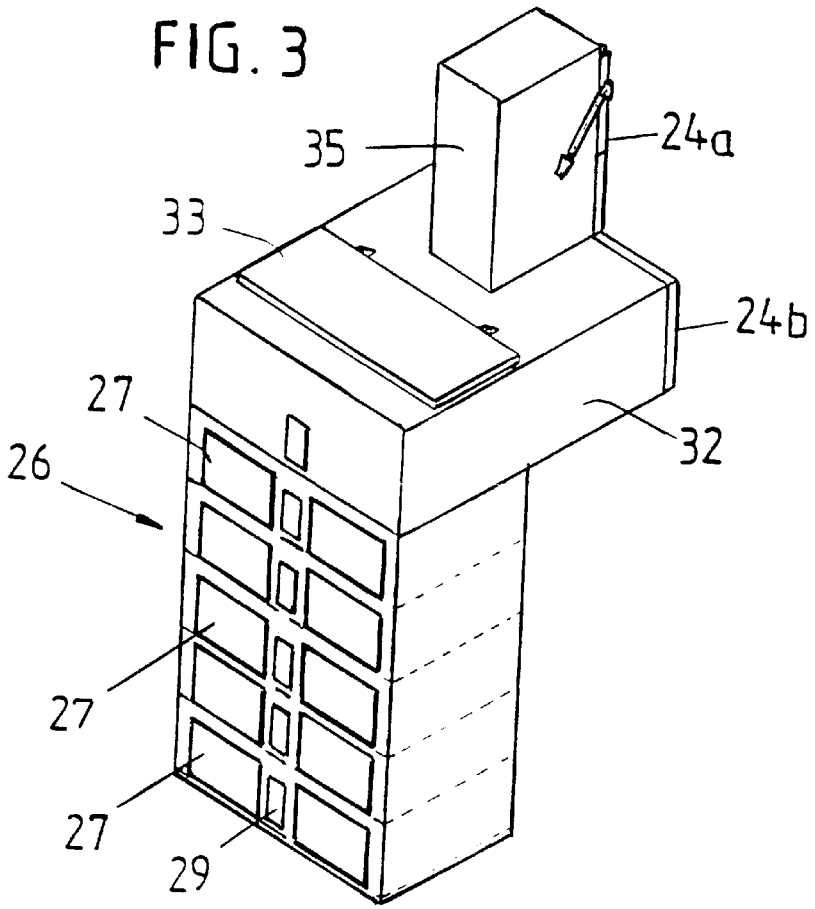
FIGS. 3 and 4 show in perspective from opposite sides a combined elevator shaft and housing arrangement, which is designed for reception of and defining of two mutually separate load and unload lines for each of its separately defined holds.
Figure 4:
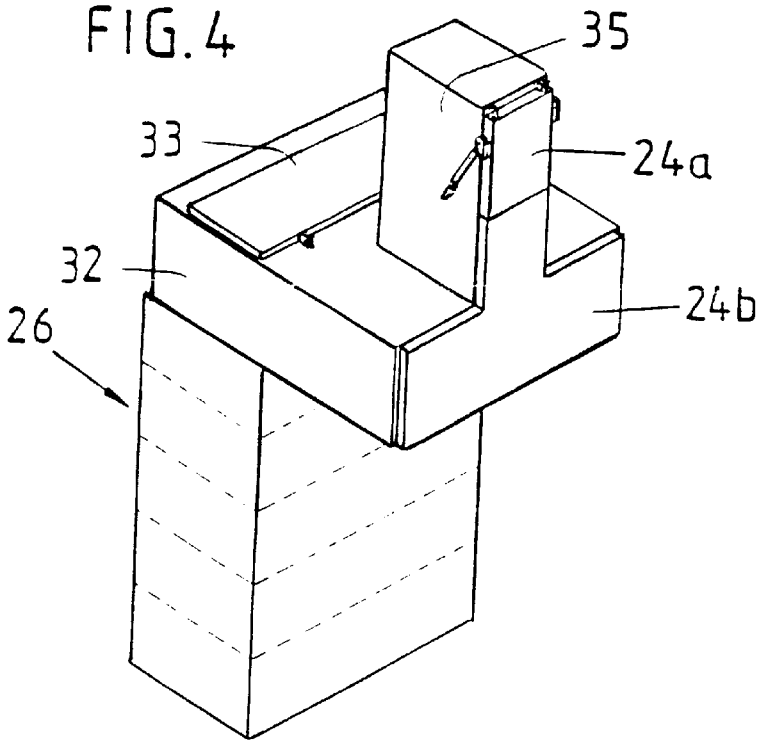
Figure 7:
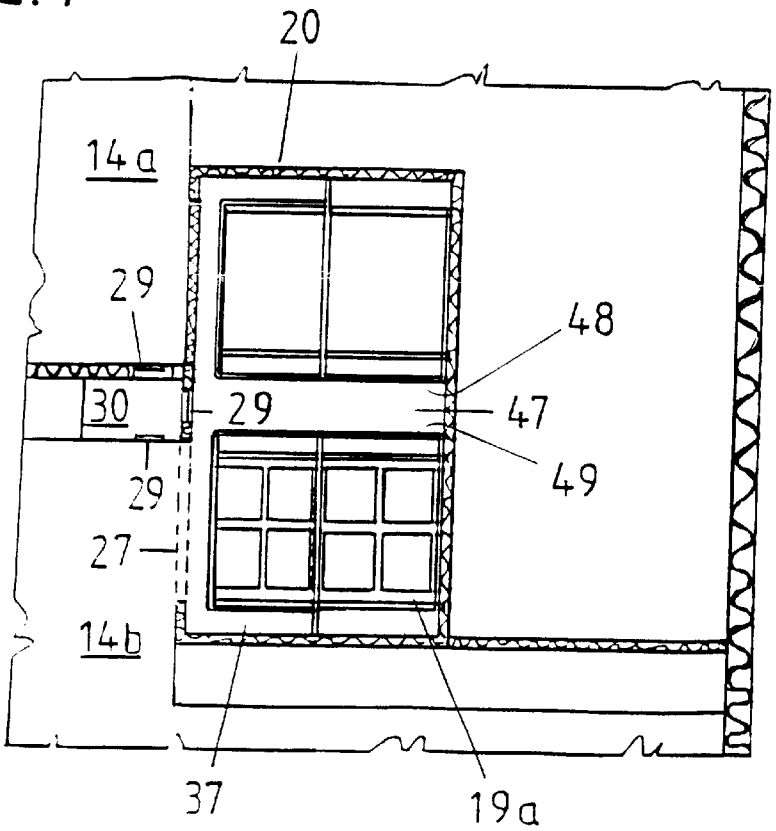
FIG. 7 shows in plan a section of two neighbouring holds with associated common elevator shaft and two internal elevators.

In FIGS. 3 and 4 the separate elevator shaft/housing arrangement 26 is shown, which can include two separate load and unload lines according to the invention, that is to say an arrangement 26 which can be employed for the loading and unloading of respectively two mutually separated holds 14*a*,14*b* and 14*c*,14*d* separately. The arrangement 26 comprises a common elevator shaft 20 for serving the two holds and is provided with a series of cargo openings 27 arranged one above the other having associated pivotable ports 27*a* (see FIG. 5) for respective loading decks 28*a*–28*e* or for corresponding room portions or corresponding floors in the hold. There are shown in FIGS. 3 and 4 and FIG. 7 respectively corresponding personal access openings 29 to a room 30, which is defined in a partition wall between the holds 14*a*,14*b*, plus corresponding personal access openings 29 from the room 30 to the respective hold 14*a*,14*b*. Each of the openings 29 can normally be covered by a door (not shown further), which preferably opens inwardly into the room 30.

In the illustrated embodiment four separate load and unload lines are employed, that is to say a line for each hold. Provision is made for two neighbouring lines to be received in each elevator shaft/housing arrangement 26, so that two neighbouring holds can be served via a common elevator shaft/housing arrangement and a common port opening. This means that during normal operation the neighbouring holds can be loaded and unloaded independently of each other, but also that the loading and unloading can alternatively take place for single holds via both load and unload lines simultaneously, as required.

There is only described herein in detail the one load and unload line, since the remaining load and unload lines function in a corresponding manner. However, the two load and unload lines in one and the same elevator shaft/housing arrangement 26 have, as mentioned, a certain mutual possibility of communication within the illustrated arrangement.

Figure 2:
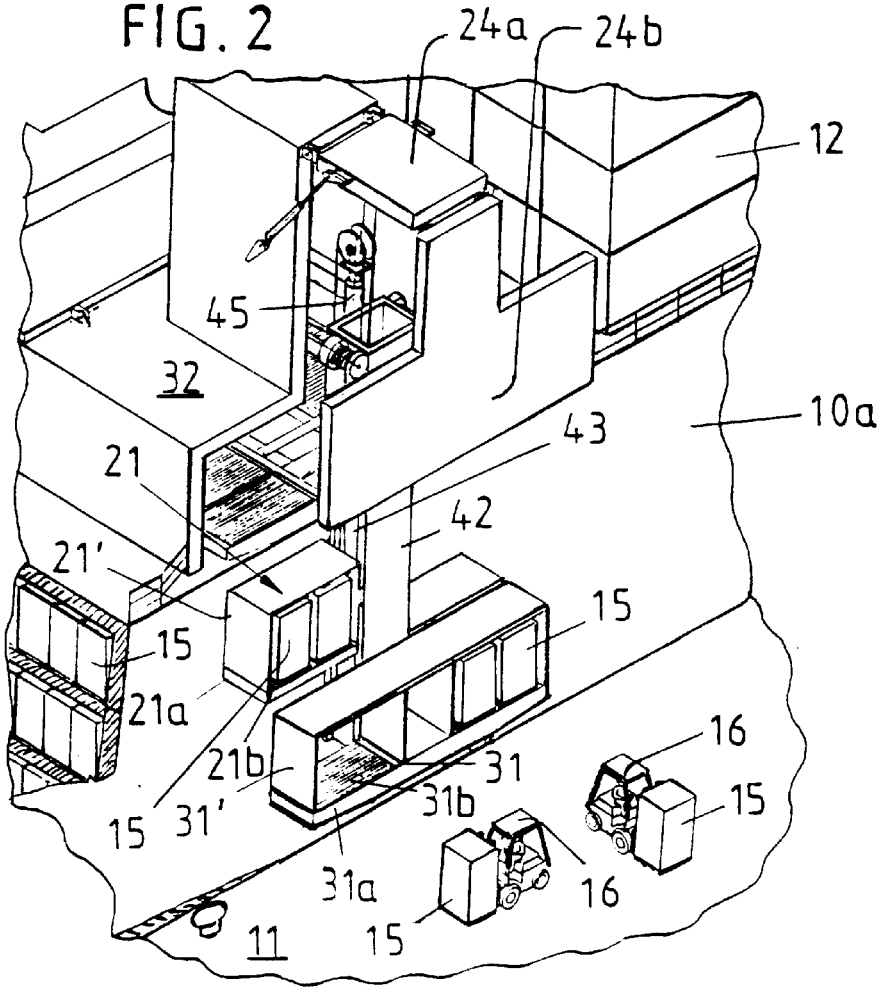
FIG. 2 shows in perspective a section of the ship according to FIG. 1 and associated external elevators, which form a part of a pair of mutually adjacent load and unload lines.

In each loading and unloading system there is employed a first, internal elevator 19 in an associated elevator shaft 20 and a second, external elevator 21, which is supported in a carriage 22, which is driveable on rails 38 on deck 13 of the ship, for transporting the elevator 21 from an active position, along the outer side of side 10*a* of the ship as shown in FIG. 2, to an inactive position received in an elevator shaft/housing arrangement 26 on the deck 13. In the illustrated embodiment the carriage 22 is common to two separate load and unload lines.

Figure 6:
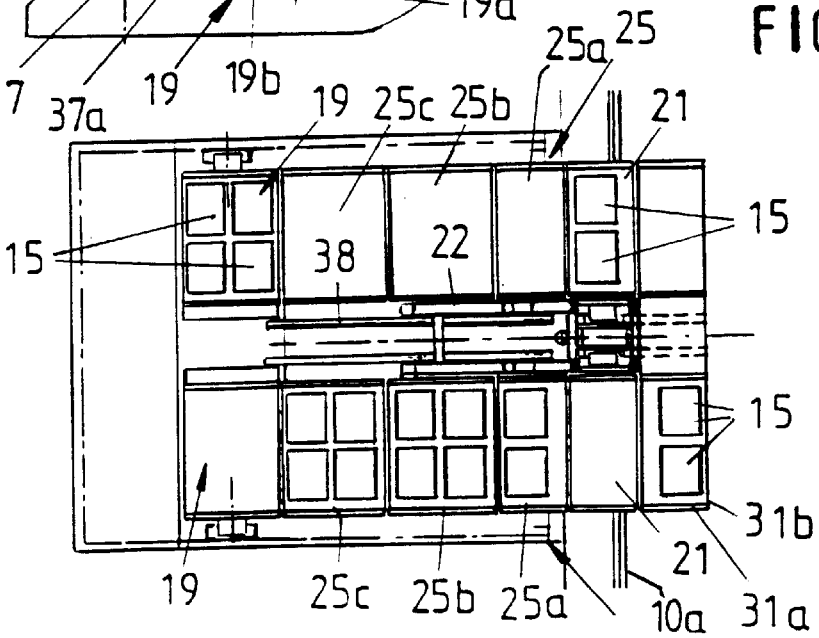
FIG. 6 shows in plan a section of that part of the elevator shaft/housing arrangement, which is arranged on the upper deck and which forms a communication between the external elevator and the internal elevator via an intermediate buffer zone.

As shown in FIG. 6 the carriage 22 and associated rails 38 are placed between the buffer zones 25 in the two parallel load and unload lines.

A two part hatch 24*a*,24*b*, which in the inactive position of the elevator 21 is adapted to cover the port opening 17 (18) in the housing arrangement 26 to close the housing arrangement 29 in FIGS. 1, 2 and 5, is swung upwards and outwards to an open use condition, while the external elevator 21 is shown correspondingly in an active use condition along the outer ship's side 10*a* of the vessel 10.

It is evident from FIG. 5 that the cargo units 15 can be moved in one and the same plane of movement in each load and unload line, that is to say by means of fork lift trucks 16 horizontally on the quay 11 and via a horizontal conveyor 31*b* on a loading platform 31*a* in a buffer zone 31 to a horizontal conveyor 21*b* on an elevator platform 21*a* in the elevator 21, vertically in the elevator 21 on the side 10*a* of the ship, horizontally on conveyors 25*a*,25*b*,25*c* in the buffer zone 25 on the deck 13, vertically in the elevator 19 in the elevator shaft 20 and horizontally on a conveyor 37*a* in a buffer zone 37 and further with fork lift trucks 16 into place in the hold.

A relatively simple elevator 21 can be used for transporting cargo units 15 to and from the quay 11, from and to upper deck 13 of the ship. In practice a loading platform 31*a* and an elevator platform 21*a* are shown, which can each receive two units 15 of cargo at a time by the side of each other.

Correspondingly, a larger elevator 19 can be employed internally in the ship for freighting a larger number of cargo units 15 at a time to and from the associated hold. In practice an internal elevator 19 is shown having an elevator platform 19*a*, which can receive two pairs, that is to say four cargo units 15 at a time.

Each of the two elevators 19 extends on its respective mutually opposite side of the elevator shaft 20 in its respective guide 40 and is served by its respective separate elevator machinery 41. Correspondingly, the external elevators 21 extend on their respective side of a common support column 42 in their respective guide 43 and are served by each their separate elevator machinery 44. The loading platform 31 is carried by the lower end of the support column 42 on the side which lies between the guides 43. The support column 42 with associated loading platform 31 is lifted and lowered, by means of elevator machinery or similar lifting or pushing equipment 45, to various levels along the side 10*a* of the ship depending upon the vertical movements of the vessel relative to the level of the quay. The support column 42 and the loading platform 31 are shown in broken lines in an upper position in readiness for drawing in to the inactive position on the ship's deck 13.

With the relatively short elevator height between the quay 11 and the ship's deck 13 it is possible to effect more frequent elevator operations with less cargo in the elevator 21 than on the elevator 19, while the elevator 19 can have a substantially greater elevator height and have larger cargo in each elevator operation. By means of the buffer zone 25 a larger number of cargo units 15 can be intermediately stored between the elevators 19 and 21, as required, with at the same time an effective utilisation of the loading and unloading capacity on the quay 11 and in the hold 14.

On the top of the housing portion 32 an upswingable cover 33 is shown, which in the position as illustrated in FIGS. 3 and 4 covers a hatch opening for the elevator shaft 20. On normal operation the transport lines internally in the ship can be kept protected against weather and wind. Alternatively, for example if the normal loading and unloading system should fail for one reason or another, there is furthermore the possibility that cargo units 15 can be handled with conventional lifting cranes inwardly into the ship or outwardly from the ship for different decks in a traditional manner via the hatch opening at the top of the elevator shaft 20.

On the top of the housing portion 32 there projects further upwards a tower-forming housing portion 35, which is adapted to receive certain upwardly projecting parts 36 (see FIG. 5) of the external elevator 21 in its inactive position. In FIG. 5 the elevator 21 is shown in broken lines with associated equipment in an upper, active condition just outside the port opening 17 in readiness for pushing in by means of the carriage 22 to an inactive condition in the housing portion 32 and associated housing portion 35.

The housing arrangement 26 can, if desired, be manufactured and mounted as a separate unit in the ship. By means of the housing arrangement 26 a protected transportation can be effected internally in the ship with an effective covering of the cargo against weather and wind during the loading and unloading operations. Correspondingly, elevator machinery and the like can be effectively covered during use of the system, and also the second elevator 21 can be effectively covered in its inactive position.

The housing arrangement 26, which borders up to the associated holds 14*a*,14*b*, is provided as is shown in FIGS. 5 and 7 with temperature-insulated walls 26*a*, in order to limit the cooling of the units of cargo to the holds Per se.

Figure 8:
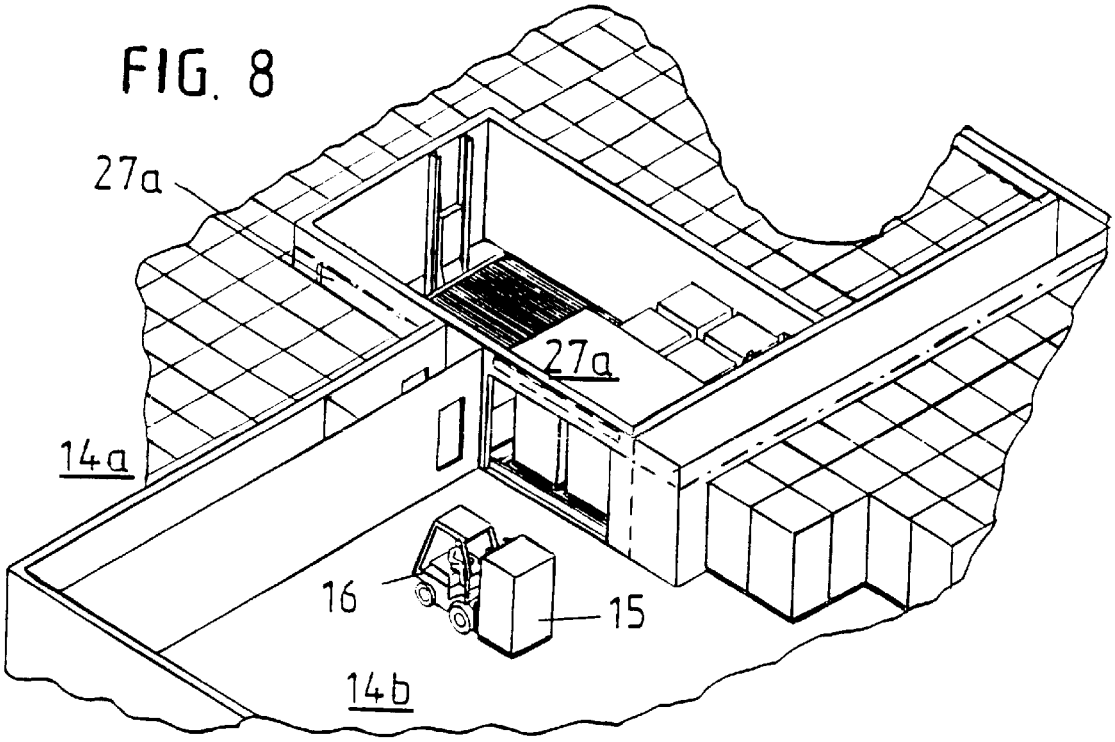
FIG. 8 shows in perspective, in a section of the holds as shown correspondingly in FIG. 7, an associated elevator shaft for two adjacent internal elevators.

In FIG. 8 the one hold 14*a* is shown ready filled with cargo units 15, with the associated port 27*a* illustrated in the closed position, while the other hold 14*b* is shown with an open port 27*a*, that is to say with the port 27*a* swung upwards and outwards in the elevator shaft 20. In FIGS. 7 and 8 half the elevator shaft 20 (in connection with the hold 14*a*) is shown employed as a buffer zone 37 between the elevator 21 and the hold 14*a*. With such a solution cargo, for example in the form of four cargo units 15, can be stored in the buffer zone 37, in readiness for transfer collectively and in one rapid operation from the buffer zone 37 to the loading platform 19*a* of the elevator. There can be employed an automatically controlled conveyor 37*a* in the buffer zone 37 and an automatically controlled conveyor 19*b* on the loading platform 19*a* for the automatic transfer of cargo between the buffer zone and the elevator immediately conveyor 19*b* of the elevator 19 assumes its loading and unloading position flush with the conveyor 37*a* in the buffer zone 37. In practice certainly half the elevator shaft 20 can be provided with a stationary floor partition 47 with two associated cavities 48,49 for the two internal elevators 19. In such a case the floor partition 47 is used as a driving foundation for fork lift trucks in the instances these are to be transferred from the one load and unload line to the other. The port 27*a* forms in the upswung position a protective cover over the buffer zone 37, so that the operators of the fork lift trucks can work in a relatively well shielded work zone on transporting cargo to and from the hold from and to the buffer zone.

I claim:

1. In combination, a cargo vessel having a stationary upper deck extending over a substantial portion thereof for receiving cargo and a vertical elevator shaft communicating with said deck and extending downwardly therefrom;

at least a first elevator movable within said elevator shaft to convey cargo units thereon;

at least a second elevator mounted on said vessel and movable externally of said vessel to convey cargo thereon between said vessel and a quay, said second elevator being spaced from said first elevator to define a buffer zone therebetween to receive cargo units; and at least one horizontal conveyor on said deck between said elevators for conveying cargo units therebetween.

2. The combination as set forth in claim 1 wherein said second elevator is movable on a vertical axis.

3. The combination as set forth in claim 1 having a pair of said first elevators, a pair of said second elevators, and a common housing mounted on said deck of said vessel over said pair of first elevators.

4. The combination as set forth in claim 3 which further comprises at least one stationary floor partition below said deck and between said pair of first elevators for transferring cargo units to and from respective ones of said pair of first elevators.

5. The combination as set forth in claim 1 which further comprises a housing mounted on said deck of said vessel over said first elevator.

6. The combination as set forth in claim 5 wherein said second elevator is movable horizontally to an inactive position within said housing and said housing has a hatch cover for closing said second elevator within said housing.

7. The combination as set forth in claim 5 which further comprises horizontal rails in said housing and a carriage movable along said rails and supporting said second elevator thereon for movement between an inactive position within said housing and an active position externally of said vessel.

8. The combination as set forth in claim 7 which further comprises a carrier member on said carriage, a support column vertically displaceable in said carrier member, a buffer forming loading ramp on a lower end of said column and at least one conveyor on said ramp for conveying cargo units thereon.

9. The combination as set forth in claim 8 which further comprises an elevator guide on said support column for guiding said second elevator thereon, an elevator platform on said second elevator and a conveyor on said elevator platform for alignment with said conveyor on said loading ramp to convey cargo units therebetween.

10. A system for loading and unloading cargo units in cargo vessels, said system comprising a housing for mounting on an upper stationary deck extending over a substantial portion of a vessel;

a first elevator depending from within said housing to convey cargo units into a vessel;

a second elevator movable horizontally between an inactive position within said housing and an active position outside said housing, said second elevator being movable vertically along a vetica axis externally of the vessel to convey cargo units between the vessel and a quay, said second elevator being spaced from said first elevator to define a buffer zone on the upper deck and between said elevators to receive cargo units; and a plurality of horizontal conveyors on the upper deck between said elevators for sequentially conveying cargo units therebetween.

11. The combination as set forth in claim 10 which further comprises horizontal rails in said housing and a carriage movable along said rails and supporting said second elevator thereon for movement between said inactive position within said housing and an active position horizontally outside said housing.

12. The combination as set forth in claim 11 which further comprises a carrier member on said carriage, a support column vertically displaceable in said carrier member, a buffer forming loading ramp on a lower end of said column and at least one conveyor on said ramp for conveying cargo units thereon.

13. The combination as set forth in claim 12 which further comprises an elevator guide on said support column for guiding said second elevator thereon, an elevator platform on said second elevator and a conveyor on said elevator platform for alignment with said conveyor on said loading ramp to convey cargo units therebetween.

14. In combination a cargo vessel having an upper deck extending over a substantial portion thereof and a plurality of holds below said deck;

a housing arrangement mounted on said upper deck of said cargo vessel and extending above said upper deck;

a vertical elevator shaft within said housing arrangement and extending downwardly to said holds;

at least a first elevator movable within said elevator shaft to convey cargo units thereon;

at least a second elevator mounted in said housing arrangement for movement externally of said vessel to convey cargo between said upper deck of said vessel and a quay;

at least one horizontal conveyor in said housing arrangement between said elevators and on said upper deck to define a buffer zone within said housing arrangement to receive cargo units and to convey cargo units between said elevators.

15. The combination as set forth in claim 14 wherein said second elevator is retractable within said housing arrangement.

16. The combination as set forth in claim 14 wherein said housing arrangement has a part defining an internal chamber housing said buffer zone therein.

17. The combination as set forth in claim 16 wherein said part has a cover on a top thereof in alignment with said elevator shaft.

18. The combination as set forth in claim 14 wherein said housing arrangement has a plurality of vertically disposed closeable openings for communicating with respective decks within said vessel and for communicating with said elevator shaft for passage of cargo units therebetween.

19. The combination as set forth in claim 18 wherein said housing arrangement has a pair of said vertically disposed openings therein to communicate said elevator shaft with two neighboring holds in said vessel.

* * * * *

UNITED STATES PATENT AND TRADEMARK OFFICE

CERTIFICATE OF CORRECTION

PATENT NO. : 5,915,905

DATED : June 29, 1999

INVENTOR(S) : Mortiz Hopland

It is certified that error appears in the above-indentified patent and that said Letters Patent is hereby corrected as shown below:

Column 8, line 54, change "vetica" to -vertical-

Signed and Sealed this

Ninth Day of November, 1999

*Attest:*

*Attesting Officer*

Q. TODD DICKINSON

*Acting Commissioner of Patents and Trademarks*